United States Patent [19]

Fiorella

[11] Patent Number: 4,724,605

[45] Date of Patent: Feb. 16, 1988

[54] METHOD FOR MAKING AREA ACTUATED SWITCH

[75] Inventor: Charles M. Fiorella, Lubbock, Tex.

[73] Assignee: Texas Instruments Incorporated, Dallas, Tex.

[21] Appl. No.: 396,506

[22] Filed: Jul. 8, 1982

Related U.S. Application Data

[62] Division of Ser. No. 193,214, Oct. 1, 1980, Pat. No. 4,360,716.

[51] Int. Cl.[4] ..... H01H 11/00

[52] U.S. Cl. ..... 29/622; 156/216; 156/227; 156/307.7

[58] Field of Search ..... 29/622; 156/307.7, 216, 156/227; 200/5 R, 5 A, 86 R, 159 B, 292, 293, 302; 361/398

[56] References Cited

U.S. PATENT DOCUMENTS

| | | | |
|---|---|---|---|
| 2,843,695 | 7/1958 | Osuch et al. | 200/86 R |
| 3,668,337 | 6/1972 | Sinclair | 200/159 B |
| 4,066,851 | 1/1978 | White et al. | 361/398 |
| 4,131,991 | 1/1979 | Riniker | 29/622 |
| 4,307,275 | 12/1981 | Larson et al. | 200/292 |
| 4,317,013 | 2/1982 | Larson | 29/622 |
| 4,320,573 | 3/1982 | Larson | 29/622 |

*Primary Examiner*—P. W. Echols

*Attorney, Agent, or Firm*—John A. Haug; James P. McAndrews; Melvin Sharp

[57] ABSTRACT

Disclosed is an area actuated switch which can be used, by way of example, in a keyboard for a calculator, learning aid or the like. An area actuated switch array is formed using two insulating sheets made of polyester or polycarbonate; the insulating sheets overlie one another such that one side of each sheet faces one another. Groups of spaced conductors formed on each of the facing sides also overlie one another, and selected conductors traverse the periphery of the keyboard. A plurality of raised, insulating spacer areas or points are positioned on the facing sides and are in registration and contact with each other. An insulating substrate is formed over the conductors traversing the periphery and this insulating substrate has substantially the same thickness as the spacer points such that the spacer points and the insulating substrate prevent the spaced conductors from making electrical contact. An adhesive coating, which may be heat or pressure sensitive, is applied to the spacer points and the insulating substrate to bond these two parts together. The bond created by the adhesive coating over the insulating substrate prevents contamination of the keyboard from dust, humidity and the like. The keyboard structure, therefore, may have an infinite active area such that when pressure is applied anywhere within the periphery of the switch array, electrical contact is made.

15 Claims, 7 Drawing Figures

METHOD FOR MAKING AREA ACTUATED SWITCH

This application is a division, of application Ser. No. 193,214, filed 10/01/80, now U.S. Pat. No. 4,360,716.

This invention relates to switches and more particularly to a method and apparatus for fabricating an area actuated switch.

U.S. Pat. No. 4,066,851 entitled "Keyboard Switch Assembly having Foldable Printed Circuit Board, Integral Spacer and Preformed Depression-Type Alignment Fold" is typical of prior art keyboard switches and construction. The switch illustrated and described in the before-mentioned patent utilizes a sheet of flexible, nonconductive plastic which is preformed in a predetermined manner for supporting conductors running normally in an x and y direction as shown in FIG. 1. In FIG. 2 there is disclosed an insulating spacer 37 having spacer holes 37-1. The insulating spacer 37 is placed on top of bottom layer portion 30-5 and the top layer 30-4 is folded over insulating spacer 37-1 as shown in FIGS. 4 and 5. Therefore, when the top sheet is depressed by a human finger applied to the sheet, electrical contact is made through spacer holes 37-1. Pressure could be brought to bear at locations on sheet 30-4 (in FIG. 4) other than over spacer holes 37-1 and electrical contact would not be made; in other words, electrical contact is only made between the conductors on the top and bottom sheets where the top sheet conductors may be depressed through one of the insulating spacer holes 37-1. This type of keyboard requires an additional insulating layer with apertures located therein and is limited to contact being made at a point where the x and y conductors cross through an insulating spacer hole.

Accordingly it is an object of the present invention to provide a method and apparatus for producing a switch which is activated over an area rather than a point.

Another object of the present invention is to provide a keyboard having areas which are actuatable rather than discrete points or locations.

Another object of the present invention is to provide a data processor having an input means which is actuatable over discrete areas.

Another object of the present invention is to provide a method for manufacturing an area actuated switch which is easy to manufacture by reducing the number of individual parts required or labor to assemble it.

Another object of the present invention is to produce a keyboard which is simple yet lends itself to mass production methods of manufacturing.

Other objects and features of the invention will become more readily understood from the following detailed description and appended claims when read in conjunction with the accompanying drawings, in which like reference numerals designate like parts throughout the figures thereof, and in which:

Figure 1:
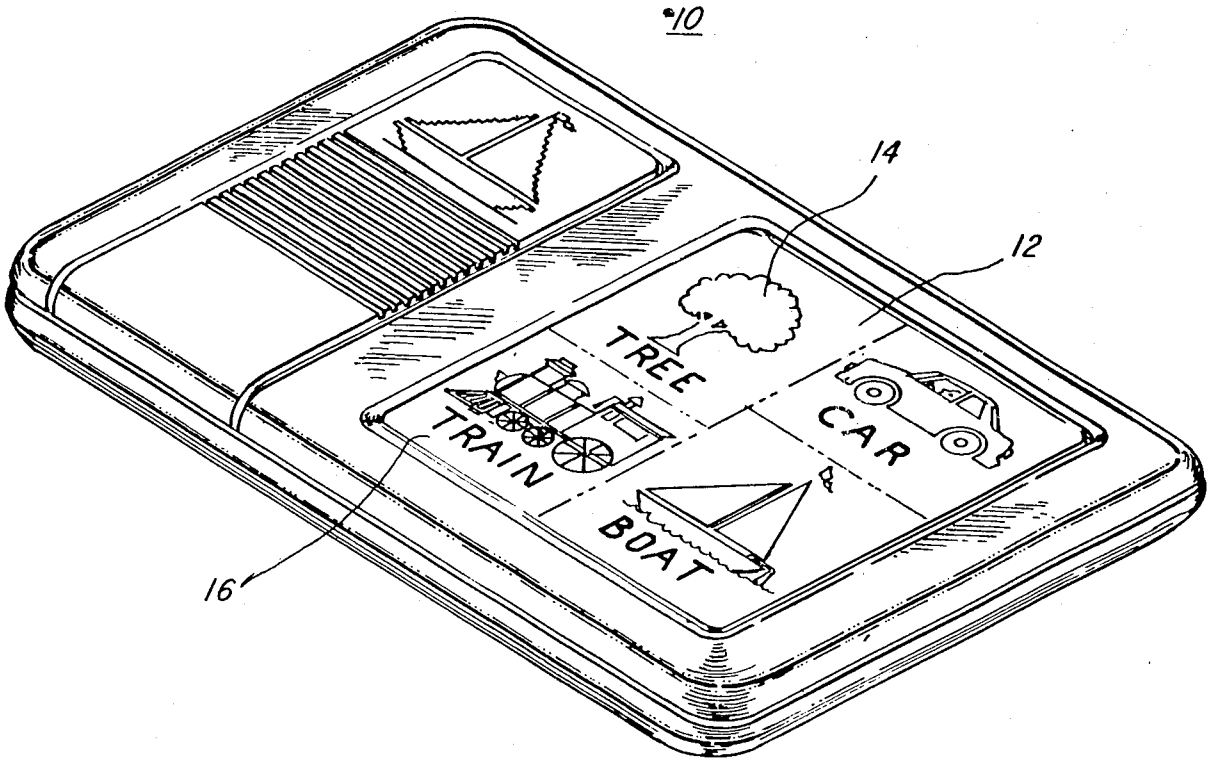
FIGS. 1 and 2 are perspective views of a learning aid using a keyboard according to the present invention.
Figure 2:
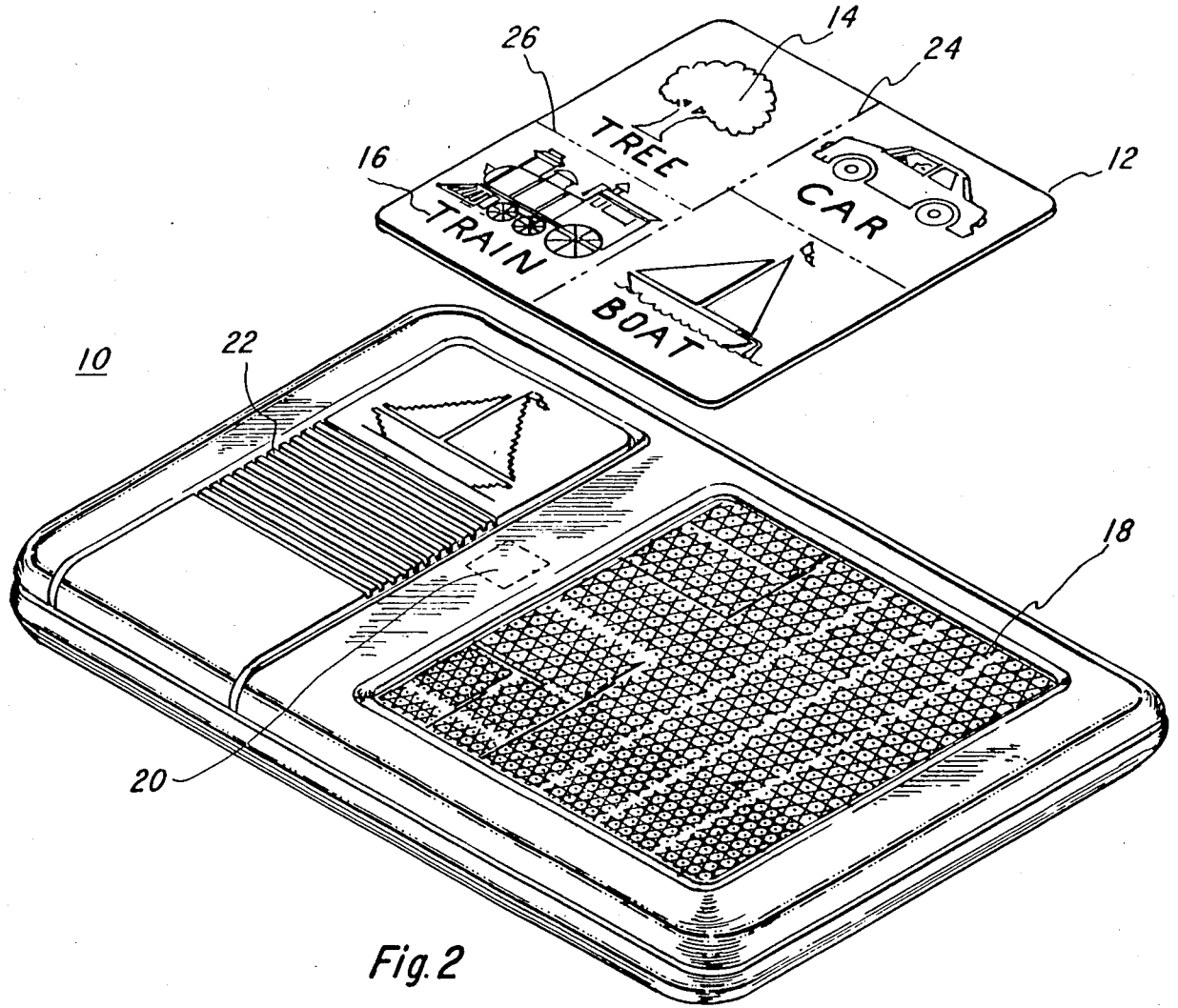

Referring now to FIGS. 1 and 2, there is disclosed a data processor 10 which, by way of example, may be a calculator or a learning aid. Learning aid 10 is made up of a template 12 having pictures 14 and/or words 16 thereon, a keyboard 18 according to the present invention, an electronic circuit means 20 and an output means which, for purposes of illustration, is shown as speaker 22. The electronic circuit means 20 is comprised of three chips manufactured and sold by Texas Instruments Incorporated, Dallas, Tex. a controller chip No. 1100CD8010, a speech storage chip No. TMC350CD3537 and a speech synthesizer chip No. TMC280CD2802. When learning aid 10 is actuated, it requests an operator to press one of the four pictures on template 12; if the learning aid requests the operator to press tree 14, then the operator will place his finger (or hand) onto the area of the tree bounded by lines 24 and 26. If the operator touches the correct area within lines 24 and 26, then learning aid 10 indicates to the operator that he has correctly identified the tree; if he touches the wrong area, then learning aid 10 orally advises the operator that he has touched the wrong area of template 12.

Keyboard 18 is constructed such that if an operator touches template 12 anywhere within a specified area, the keyboard switch will be closed which will produce an output signal from the keyboard to electronic circuit means 20. Electronic circuit means 20 processes the information to determine the area source of the input signal and then activates the output means (speaker 22) which could be oral or visual to indicate whether the operator has pressed the correct area on template 12. Because the operator must obtain a response from learning aid 10 from each and every position in which he pushes on template 12 (and the keyboard underneath), keyboard 18 may not have any "dead spaces" where a response would not be obtained; in other words, keyboard 18 beneath template 12 must have an infinitely active switch area.

Figure 3:
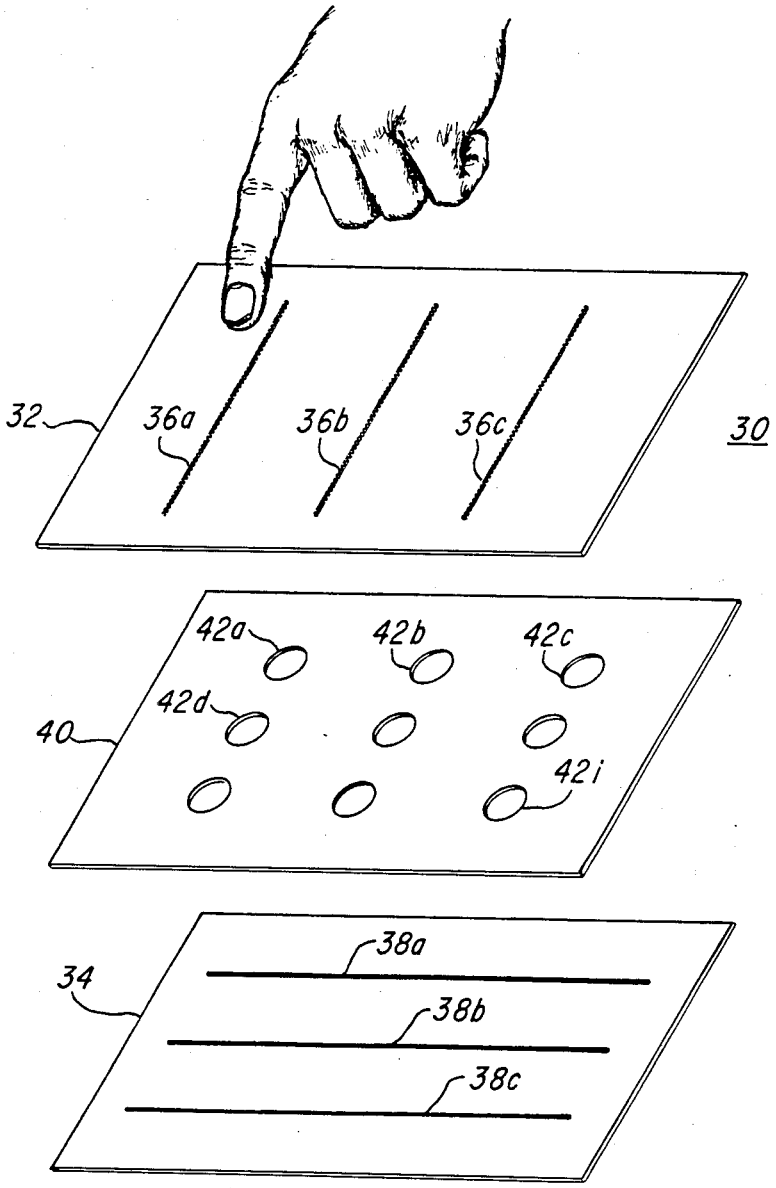
(PRIOR ART) Fig. 3
FIG. 3 is a view of a prior art keyboard.

This is contrasted with the prior art keyboard described in U.S. Pat. No. 4,066,851 mentioned above and as simplified and shown in FIG. 3. The flexible keyboard 30 illustrated in FIG. 3 is comprised of two flexible insulating substrates 32 and 34 having conductors 36*a–c* and 38*a–c* thereon. Interposed between substrates 32 and 34 is an insulating sheet 40 having a plurality of apertures 42*a–i* therein. When pressure is applied (by a finger or hand, for example) to top substrate 32 overlying aperture 42*a*, for example, in insulating sheet 40, conductor 36*a* on top substrate 32 is pressed through the aperture 42*a* to make electrical contact with conductor 38*a* on lower substrate 34. However, as can be seen in FIG. 3, there are a substantial number of places on keyboard 30 which do not overlie on one of apertures 42*a–i* in insulating sheet 40 which would not cause an electrical connection to be made if pressure were brought to bear on top flexible substrate 32.

Figure 4:
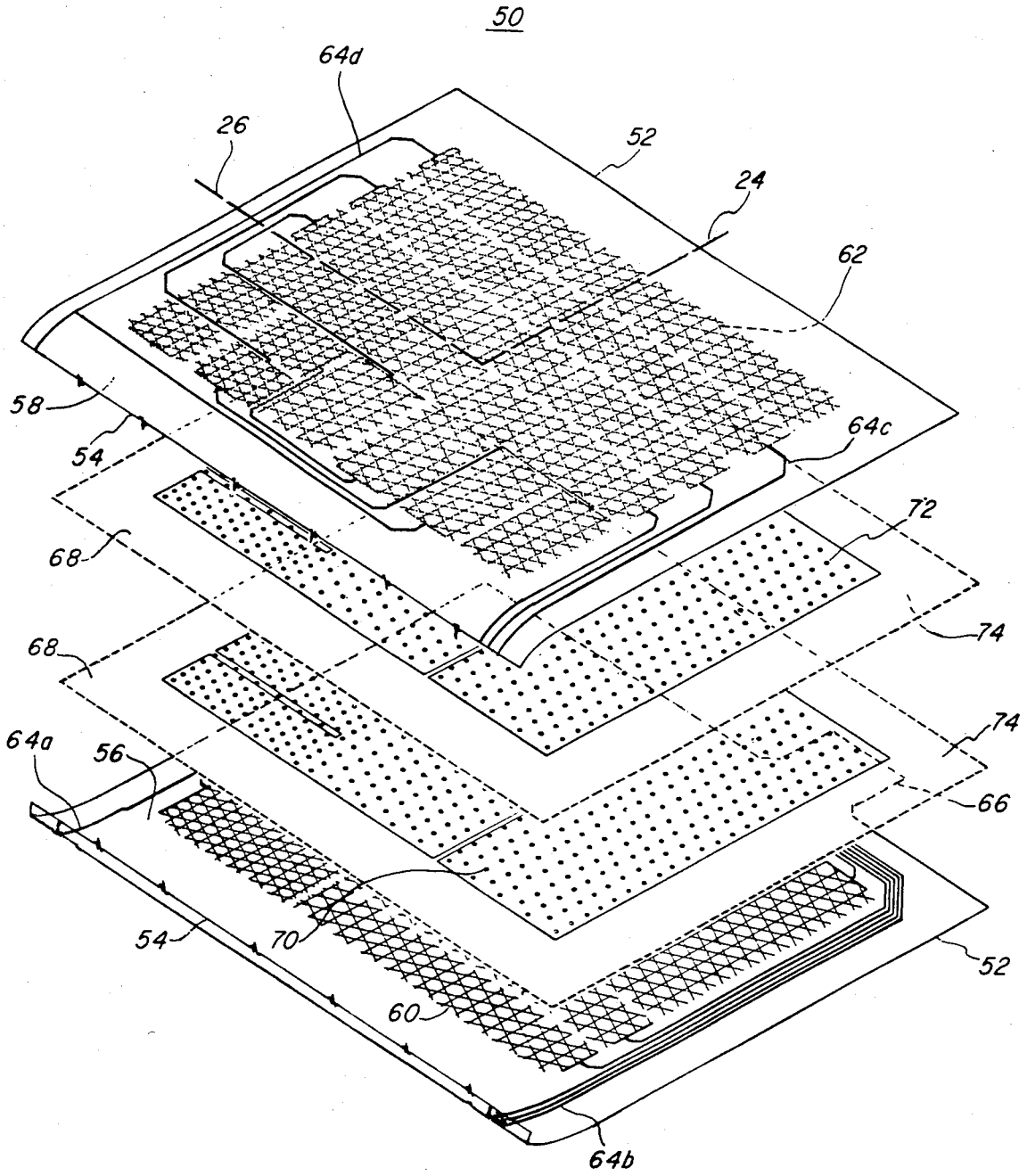
FIG. 4 is a more detailed view of the keyboard according to the present invention.
Figure 5:
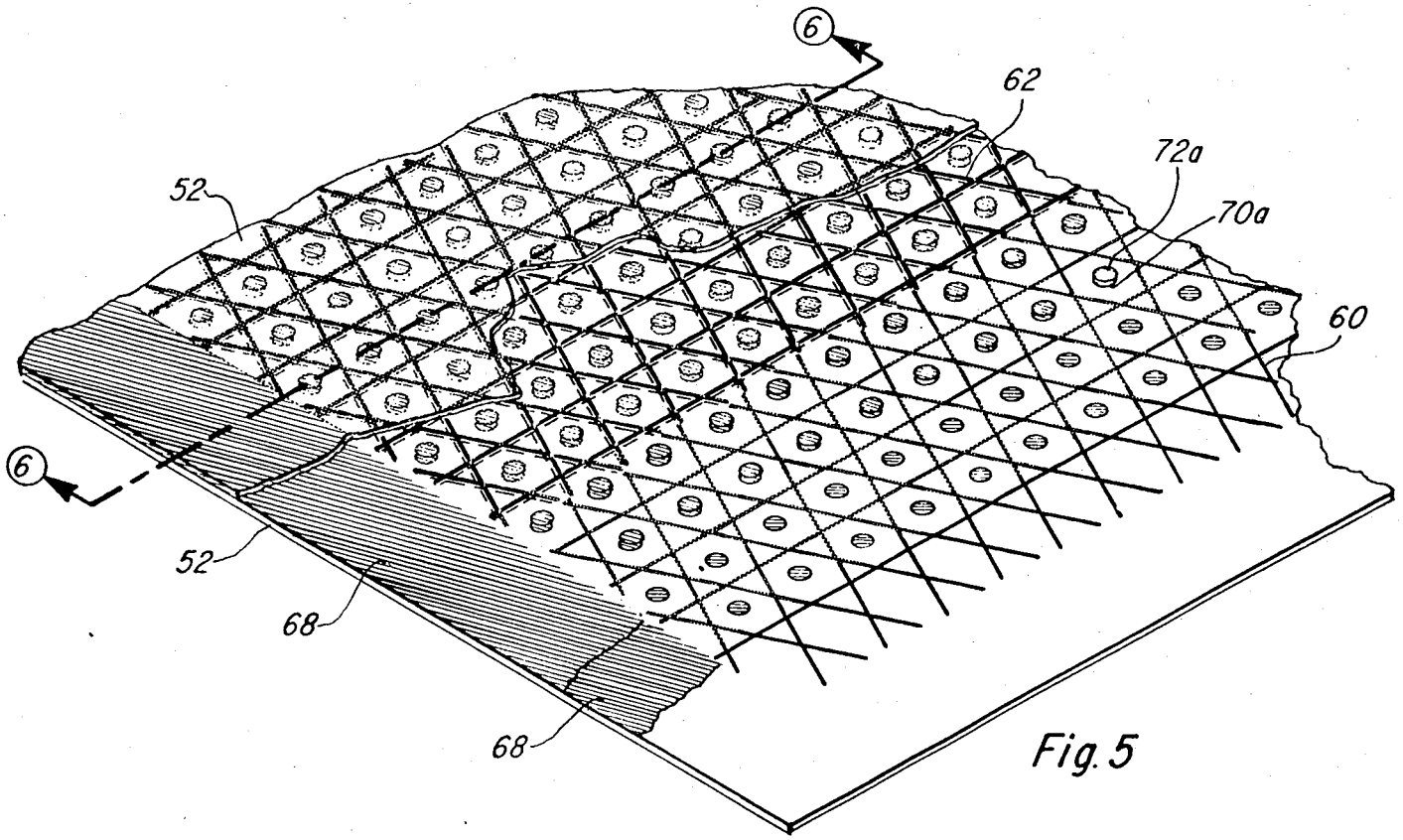
FIG. 5 is a cutaway view of the keyboard of FIG. 4.
Figure 6:
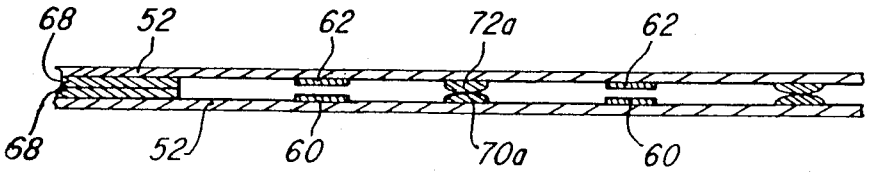
FIG. 6 is a cross-section of the keyboard of FIG. 5 taken along line 6—6 in FIG. 5.

FIGS. 4–6 illustrate the keyboard 50 constructed according to the method of the present invention. There is shown a flexible substrate, resilient sheet 52, preferably made of plastic material, having a fold line 54, and circuit supporting bottom 56 and top 58 facing sections. Sheet 52 may be made of thermoplastic or thermal setting flexible and resilient plastic materials, such as polyester, polypropylene, polyethylene, silicon rubber, polyeurethane, etc.; polyester sold under the tradename Mylar by the Du Pont Company is most preferred. Flexible substrate 52 may also be a polyamide sold under the tradename Kapton by the Du Pont Company or a polycarbonate sold under the tradename LEXAN by General Electric. Substrate 52 may have a thickness in the range of 2–30 mils but in the preferred embodiment would be approximately 5 mils thick.

Figure 7:
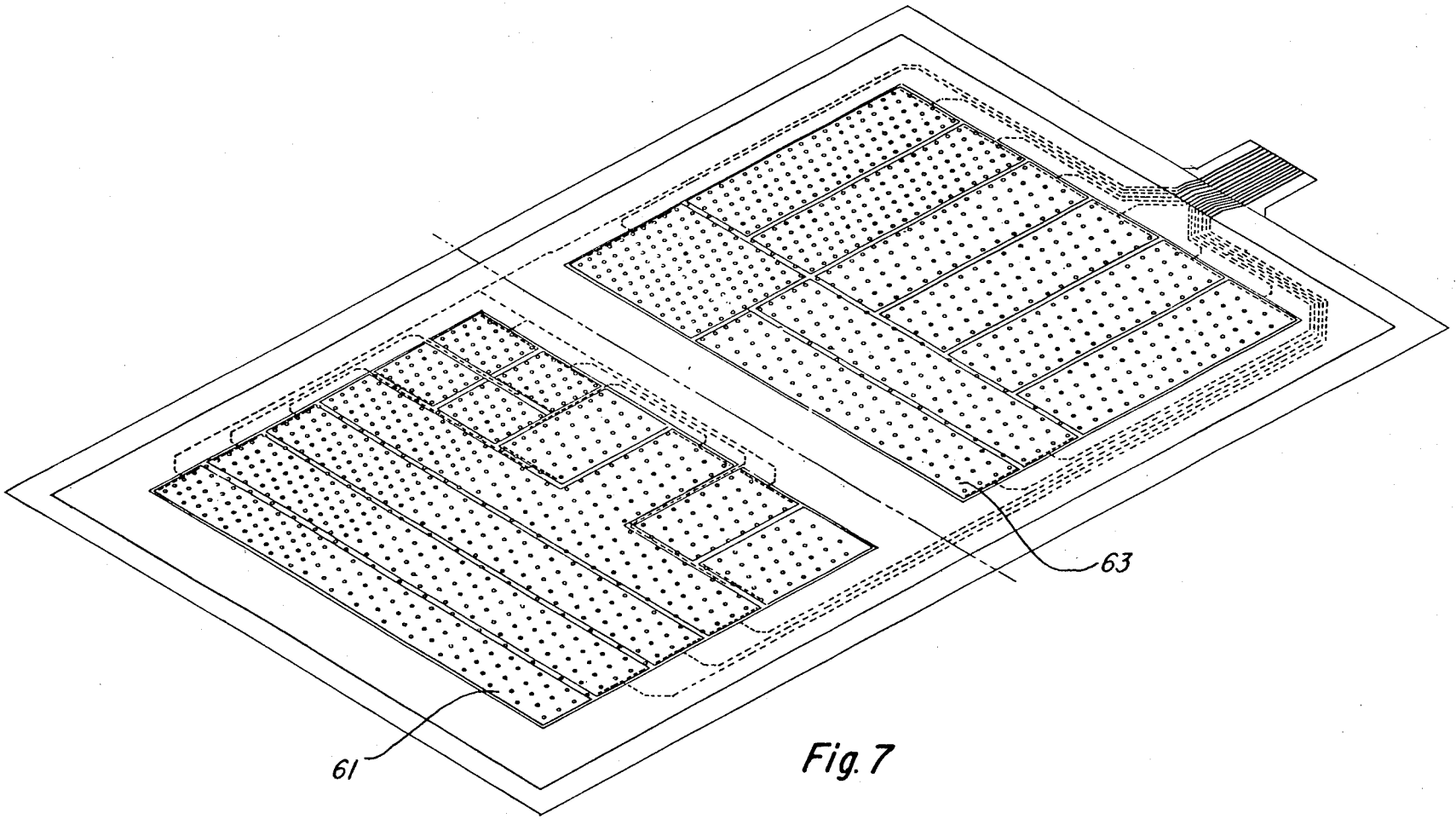
FIG. 7 is an alternate embodiment of the keyboard constructed according to the present invention.

Groups of spaced conductors 60 and 62 are formed on each of the facing sides 56 and 58, respectively, of insulating sheet 52. Conductors 60 and 62 are formed in predetermined conductive patterns which are generally similar, each pattern having at least two sets of evenly spaced, elongated conductors, the conductors of one set intersecting the conductors of a second set to form a plurality of surfaces on sheet 52 defined by the intersecting conductors. The conductors of one pattern are alignable with the conductors of the other pattern when sheet 52 is folded over on itself on fold line 54. The conductors illustrated in FIGS. 4 and 5 are shown in a star configuration; exemplary of other types of configurations would be a diamond configuration or the conductors could be solid conductors 61 and 63 as shown in FIG. 7. Conductors 60 and 62 are made of a silver/carbon composition although any conductor material could be used such as silver, copper, carbon, tin/lead etc. Conductors 60 and 62 are, in the preferred embodiment of the method, screen printed onto insulating substrate 52; other conventional techniques such as etching may be used to form the desired conductive pattern. Additional conductors 64*a–d* connected to selected ones of conductors 60 and 62 traverse the periphery of insulating sheet 52 and terminate at tail section 66. These conductors 64*a–d* carry the electrical signals when contact is made through keyboard 10 to electronic circuit means 20 (FIG. 2) which in turn is connected to an output speaker means 22. A typical switch area is formed within the boundary lines 24 and 26 illustrated in FIG. 4.

The next step in the manufacturing process is to form an insulating substrate 68 over conductors 64*a–d* traversing the periphery of each of facing sides 56 and 58 of insulating sheet 52 as well as forming insulating spacer areas or points 70 and 72 at predetermined locations on insulating sheet 52. In the preferred manufacturing technique, insulating substrate 68 and spacer points 70 and 72 will be formed simultaneously. Insulating substrate 68 is formed over conductors 64*a–d* traversing the periphery of insulating sheet 52 and is applied in a continuous or solid manner. The insulating coating, in the preferred embodiment, is screen printed onto insulating sheet 52. The thickness of the insulating substrate 68 or coating is approximately 1.5 mils, giving a total separation when both sheets are folded over at fold line 54 of approximately 3 mils thickness. Insulating coating 68 is comprised of an ultra-violet curing coating such as UV Cured Cover Coat manufactured and sold by W. R. Grace Co.

Insulating spacer points 70 and 72 in the embodiment illustrated are raised dots which are on 300 mil centers and in equilateral triangle patterns that are positioned within the center of the star configuration formed by conductors 60 and 62. These circular dots 70 and 72 have to be large enough to ensure alignment when they overlap with their counterparts on the folded-over facing side. In one embodiment, these circular insulating dots are raised approximately 1.5 mils such that when the facing side is in registration and contact with each other, the total separation is approximately 3 mils (see FIG. 6). The dots are approximately 50 mils in diameter. It will be recognized by one skilled in the art that other geometric configurations are equally acceptable and within the scope of this invention. Insulating coating 68 must be hard and not flow under pressure caused by pressing one of the sides of insulating sheet. The coating 68 described hereinabove is ultraviolet curable which is faster in the manufacturing process, requires less energy, and maintains the uniformity of thickness with ease of control.

Following the application of insulating substrate 68 and spacer points 70 and 72, an adhesive 74 is applied to the insulating substrate formed on the periphery as well as the raised, insulating spacer points. Adhesive 74 is screen printed onto insulating substrate 68 and spacer points 70*a* and 72*a* and then run through a press or roller to affix together the insulating coating around the periphery of the insulating sheet and the spacer paints. Keyboard 50 is therefore sealed around its periphery to preclude contamination from dust, humidity and the like. Adhesive 74 may be pressure sensitive or heat sensitive and, in the preferred embodiment, is an adhesive such as Acrylic Water Base Adhesive manufactured and sold by Bostick Manufacturing Company.

In the final construction of the keyboard, therefore, the keyboard is sealed around its periphery and is sealed at the raised spacer point locations. The thickness of the spacer points and the thickness of the insulator coating around the periphery are approximately equal. The raised insulating spacer points 70*a* and 72*a* prevent electrical contact from occurring between conductors 60 and 62 on the facing sides of insulating sheet 52 (see FIGS. 4 and 6). With this configuration, the switch area is effectively active (that is, there are no dead spots) over the entire area of the keyboard rather than being active only at prescribed points where opposing conductors cross over an aperture. Although this invention has been described with respect to a keyboard for a data processor or the like, other applications are realizable such as a kick or touch panel for handicapped persons or any other application where activation of a switch area rather than a switch point is required.

Although the present invention has been shown and illustrated in terms of a specific method and apparatus, it will be apparent that changes or modifications can be made without departing from the spirit and scope of the invention as defined by the appended claims.

What is claimed is:

1. A method of manufacturing an area actuated switch assembly comprising the steps of:

(a) forming two conductive patterns, each on a portion of a flexible insulating substrate means, each pattern having at least two sets of evenly spaced, elongated conductors, the conductors of one set intersecting the conductors of a second set forming a plurality of surfaces on the substrate means defined by the intersecting conductors, the conductors of the one pattern being alignable with the conductors of the other pattern, (b) forming a plurality of insulating spacer areas on said substrate means, at least one on each surface defined by the intersecting conductors of at least one conductive pattern, (c) forming an adhesive over each of said spacer areas, and (d) placing the substrate so that one conductive pattern overlies and faces the other conductive pattern, aligning the conductors of the one pattern with the conductors of the other pattern and contacting said insulating spacer areas of the one pattern with corresponding surfaces of the other pattern in proper registration to form said switch assembly.

2. The method of claim 1 wherein said conductive patterns are formed on the flexible substrate means by selectively screening a conductive material thereon.

3. The method of claim 1 wherein said insulating spacer areas are formed on said flexible substrate means by selectively screening an insulating material thereon.

4. The method of claim 3 further including the step of selectively screening said insulating material as a coating around the periphery of said assembly.

5. The method according to claim 4 wherein said forming an adhesive comprises selectively screening an adhesive on each of said spacer areas and on said insulating material on the periphery of said assembly.

6. The method of claim 5 wherein said adhesive is pressure sensitive.

7. The method of claim 5 wherein said adhesive is thermally activated.

8. The method of claim 4 further including the step of ultraviolet curing of said insulating material forming said spacer areas and coating around the periphery of said assembly.

9. The method of claim 4 wherein the height of said coating and said spacer areas are substantially equal.

10. The method of claim 1 wherein said contacting step comprises folding a portion of said substrate back onto itself to form said switch assembly.

11. The method according to claim 1 wherein said flexible insulating substrate means is a plastic material selected from the group of polyester, polycarbonate or polyamide plastics.

12. The method of claim 1 wherein said conductive patterns are in a star configuration and selected spacer areas are positioned generally in the center of said star.

13. The method of claim 1 wherein said conductive patterns are in a diamond configuration and selected spacer areas are positioned generally in the center of said diamond.

14. The method according to claim 1 wherein said spacer areas are generally circular in configuration.

15. The method of claim 1 including forming the insulating spacer areas on the surfaces of both the one pattern and the other pattern.

* * * * *